US011535422B2

(12) United States Patent
Schwarz

(10) Patent No.: US 11,535,422 B2
(45) Date of Patent: Dec. 27, 2022

(54) DEVICE FOR HOLDING OBJECTS

(71) Applicant: Alwa GmbH & Co. KG Konstruktion & Formenbau, Deißlingen (DE)

(72) Inventor: Hans Schwarz, Warthausen (DE)

(73) Assignee: Alwa GmbH & Co. KG Konstruktion & Formenbau, Deißlingen (DE)

( * ) Notice: Subject to any disclaimer, the term of this patent is extended or adjusted under 35 U.S.C. 154(b) by 0 days.

(21) Appl. No.: 17/335,612

(22) Filed: Jun. 1, 2021

(65) Prior Publication Data

US 2021/0380311 A1 Dec. 9, 2021

(30) Foreign Application Priority Data

Jun. 4, 2020 (EP) ..... 20178166

(51) Int. Cl.
*B65D 19/44* (2006.01)
*B65D 19/00* (2006.01)

(52) U.S. Cl.
CPC ..... *B65D 19/44* (2013.01); *B65D 19/0002* (2013.01); *B65D 2519/00547* (2013.01); *B65D 2519/00815* (2013.01)

(58) Field of Classification Search
CPC ..... B65D 19/44; B65D 19/0002; B65D 2519/00547; B65D 2519/0081; B65D 2519/00815

(Continued)

(56) References Cited

U.S. PATENT DOCUMENTS 4,896,612 A * 1/1990 Salloum ..... B65D 19/44 108/55.3
4,915,033 A * 4/1990 Bond ..... B65D 19/44 108/55.1

(Continued)

FOREIGN PATENT DOCUMENTS

EP 2570234 3/2013
EP 2810887 12/2014

(Continued)

*Primary Examiner* — Jose V Chen
(74) *Attorney, Agent, or Firm* — Pandiscio & Pandiscio

(57) ABSTRACT

In a device (1) for holding objects (2) consisting of: a plate-shaped support frame (4) in which a plurality of accommodation openings (5) are incorporated, and a cage (6) suitable for accommodating the respective objects (2), which cage (6) has four side walls ($\mathbf{7}_1$ to $\mathbf{7}_4$) extending perpendicular to one another and a base (8) arranged between them, the cage (6) should be able to be connected to the support frame (4) as quickly as possible and at the same time a reliable and permanent operative connection between the cage (6) and the support frame (4) should be achieved. This is made possible by the fact that an adapter (11) is provided between the support frame (4) and the cage (6), which adapter (11) has a holding pedestal (12) projecting in the direction of the support frame (4), the holding pedestal (12) can be inserted into one of the accommodation openings (5) of the support frame (4) and locked therein, and the adapter (11) is made up of four support arms ($\mathbf{13}_1$, $\mathbf{13}_2$, $\mathbf{13}_3$, $\mathbf{13}_4$) which are perpendicular to one another and by means of which a rectangular inner space (14) is formed in which the cage (6) can be inserted and is fixed by at least two undercuts which are formed respectively between two pairs of side walls ($\mathbf{7}_1$, $\mathbf{7}_2$, $\mathbf{7}_3$, $\mathbf{7}_4$) of the cage (6) and the support arms ($\mathbf{13}_1$, $\mathbf{13}_2$, $\mathbf{13}_3$, $\mathbf{13}_4$) of the adapter (11).

12 Claims, 4 Drawing Sheets

(58) Field of Classification Search
USPC ..... 108/55.1, 55.3
See application file for complete search history.

(56) References Cited

U.S. PATENT DOCUMENTS

| | | | | | |
|---|---|---|---|---|---|
| 5,154,286 | A * | 10/1992 | Gits | B65D 19/44 | 206/319 |
| 5,497,708 | A * | 3/1996 | Jeruzal | B65D 19/44 | 108/55.3 |
| 5,842,424 | A * | 12/1998 | Prevot | B65D 19/44 | 108/55.3 |
| 6,044,773 | A * | 4/2000 | Bauer | B25H 1/12 | 108/55.3 |
| 6,524,040 | B1 * | 2/2003 | Heil | B65D 19/44 | 410/67 |
| 7,077,067 | B2 * | 7/2006 | Bodde | B65D 19/44 | 108/55.1 |
| 7,997,213 | B1 * | 8/2011 | Gauthier | B65D 88/022 | 294/67.1 |
| 2008/0314789 | A1 * | 12/2008 | Thomas | A61L 2/26 | 206/572 |
| 2009/0260549 | A1 * | 10/2009 | Lauzier | B65D 19/44 | 108/55.3 |
| 2014/0090581 | A1 * | 4/2014 | Schultz | B65D 19/0095 | 248/634 |
| 2015/0151873 | A1 * | 6/2015 | Luis y Prado | B65D 19/0012 | 108/55.5 |
| 2016/0221716 | A1 * | 8/2016 | Embleton | H05K 7/20163 | |
| 2017/0027411 | A1 * | 2/2017 | Gobi | B08B 13/00 | |
| 2018/0265249 | A1 * | 9/2018 | Grutt | B65D 19/0073 | |
| 2018/0273243 | A1 * | 9/2018 | Kilibarda | B23K 37/0426 | |
| 2020/0095048 | A1 * | 3/2020 | Tosi | B65D 81/2038 | |
| 2021/0180745 | A1 * | 6/2021 | Aliwi | B65D 85/68 | |
| 2021/0229866 | A1 * | 7/2021 | Lam | B65D 19/44 | |
| 2021/0341094 | A1 * | 11/2021 | Jacobs, II | B60P 7/15 | |

FOREIGN PATENT DOCUMENTS

| | | | | |
|---|---|---|---|---|
| EP | 2810887 | A1 * | 12/2014 | B65D 19/0002 |
| EP | 3608246 | | 2/2020 | |
| FR | 2451806 | | 10/1980 | |
| JP | 2008125702 | | 6/2008 | |

* cited by examiner

DEVICE FOR HOLDING OBJECTS

REFERENCE TO PENDING PRIOR PATENT APPLICATION

This patent application claims benefit of European Patent Application No. 20 178 166.3, filed Jun. 4, 2020, which patent application is hereby incorporated herein by reference.

FIELD OF THE INVENTION

The present invention relates to a device for holding objects in accordance with the pre-characterising clause of Patent Claim 1.

BACKGROUND OF THE INVENTION

EP 3 608 246 A1 discloses such a device for holding objects, consisting of a plate-shaped support frame with rectangular accommodation openings, a holding body with an integrally formed locking pedestal, which can be inserted into one of the accommodation openings and rotated therein, and a base arranged between the holding body and the locking pedestal. Immediately adjacent to the base is a circular support section, and immediately adjacent to the support section is a rectangular holding plate attached to the pedestal in each case.

By means of the holding device disclosed therein, objects should be individually attachable in or to the holding body in order to store them and to support them against damage during the transport process. Often, such devices are also used to feed the correspondingly stored objects to a cleaning or other treatment process, for example coating.

These holding devices have proved extremely useful in practice for the separation of objects to be fed into one of the aforementioned work processes. However, these devices cannot be used for holding a variety of objects in a single cage or holding body, because their internal contours are precisely adapted to the respective objects in order to prevent possible movements of the objects inside the holding body.

For the storage of a plurality of items in a cage or holding body, the current practice is as follows: the plurality of objects are placed in a cage. Four support feet should be provided on the underside of the cage, which are locked on the support frame or on the accommodation openings incorporated in the support frame. Accordingly, the support feet are first fastened to the support frame, namely in the exactly specified area dimension of the cage, so that the cage can subsequently be placed on the four support feet.

Such devices suffer from the disadvantage that the cage is detachably connected to the respective support feet, because the cage is only placed on the four support feet; there is no anchoring between the cage and the four support feet. Consequently, the support frame and the cage attached to it can only be moved in a narrowly limited angular position. It is not possible to shake the cage, for example to optimise cleaning, because the cage would become detached from the support feet and fall down.

SUMMARY OF THE INVENTION

It is therefore the task of the present invention to develop a device for holding objects of the aforementioned type in such a way that the cage can be connected to the support frame as quickly as possible and at the same time a reliable and permanent operative connection is achieved between the cage and the support frame. Due to the prevailing locking of the cage on the support frame, various working processes should be subsequently feasible which allow rotation and/or pivoting of the cage without the cage being detached from the support frame.

This task is solved in accordance with the present invention by the features of the characterising part of Patent Claim 1.

Further advantageous embodiments of the present invention are derived from the subordinate claims.

In that an adapter is provided between the support frame and the cage, which adapter has a holding pedestal projecting in the direction of the support frame, in that the holding pedestal can be inserted into one of the accommodation openings of the support frame and can be locked therein, and in that the adapter is constructed from four support arms which run perpendicular to one another and by means of which a rectangular inner space is formed, in which the cage can be inserted and is fixed by at least two undercuts which are each formed between two pairs of side walls of the cage and the support arms of the adapter, a releasable latching connection is formed between the cage and the adapter, with the result that the cage is locked on the support frame at any desired positions during the latching condition. Consequently, the cage can be pivoted, rotated or otherwise moved together with the support frame without the cage being detached from the support frame.

Due to the undercut connection between the side walls of the cage and the support arms of the adapter, these two components can be connected or disconnected from one another quickly and easily.

In order to produce the undercut between the respective side walls and the support arms, which accordingly form the latching connection in pairs, a flexurally elastic spring bar is provided on at least two opposite side walls of the cage, which spring bar protrudes in the unloaded condition in certain regions from the plane formed by the side wall and has a latching lug facing the respective support arms of the adapter, because the outwardly protruding latching lug can thus come into operative contact with one of the respective support arms of the adapter.

For this purpose, the cross-section of the support arm is designed as a closed box section and the web of the box section facing the upper edge of the cage comes into operative contact with the latching lug of the spring bar as soon as the spring bar dips into the interior of the box section. Accordingly, in the unloaded condition, the spring bar runs inside the box section of the respective support arm and the latching lug of the spring bar lies below the bar on top of the box section on its inner side and grips around it. In this way, the undercut between the latching lug of the spring bar and the respective support arms of the adapter is established and can be released manually in a straightforward manner.

In order to be able to operate the spring bar, a projection is formed on it, which is accessible from the outside. Thus, a force can be manually applied to the projection, causing the spring bar to move into the interior of the cage and releasing the latching connection between the spring bar and the respective support arm. In this case, the spring bar in the region of the base of the cage is mounted pivotably on the respective side wall of the cage in the manner of a hinge; at the same time, the spring bar in the unloaded state thereby exerts an outwardly directed prestressing force on the latching lug, as a result of which the operative connection between the latching lug and the bar of the support arm is permanently and reliably maintained.

The cages known in the prior art could not be moved when filled because the locking connection between the cage and the support frame was designed as a pure plug-in connection which could not withstand a corresponding movement profile. It is particularly advantageous if the cage with the objects stored therein can be moved overhead or in other arbitrary directions of movement in order to carry the corresponding cleaning liquids, coating media or to perform other working processes. For this purpose, it is necessary to close the cage with a lid. In addition, several such cages can be attached or placed on top of the cage which is sealed in this manner.

If several different objects are to be stored in a cage, it is advantageous if a partition wall is attached to two opposite side walls of the cage, by means of which the interior of the cage is divided.

The drawing shows a sample embodiment configured in accordance with the present invention, the details of which are explained below. In the drawing,

DETAILED DESCRIPTION OF THE PREFERRED EMBODIMENTS

Figure 1:
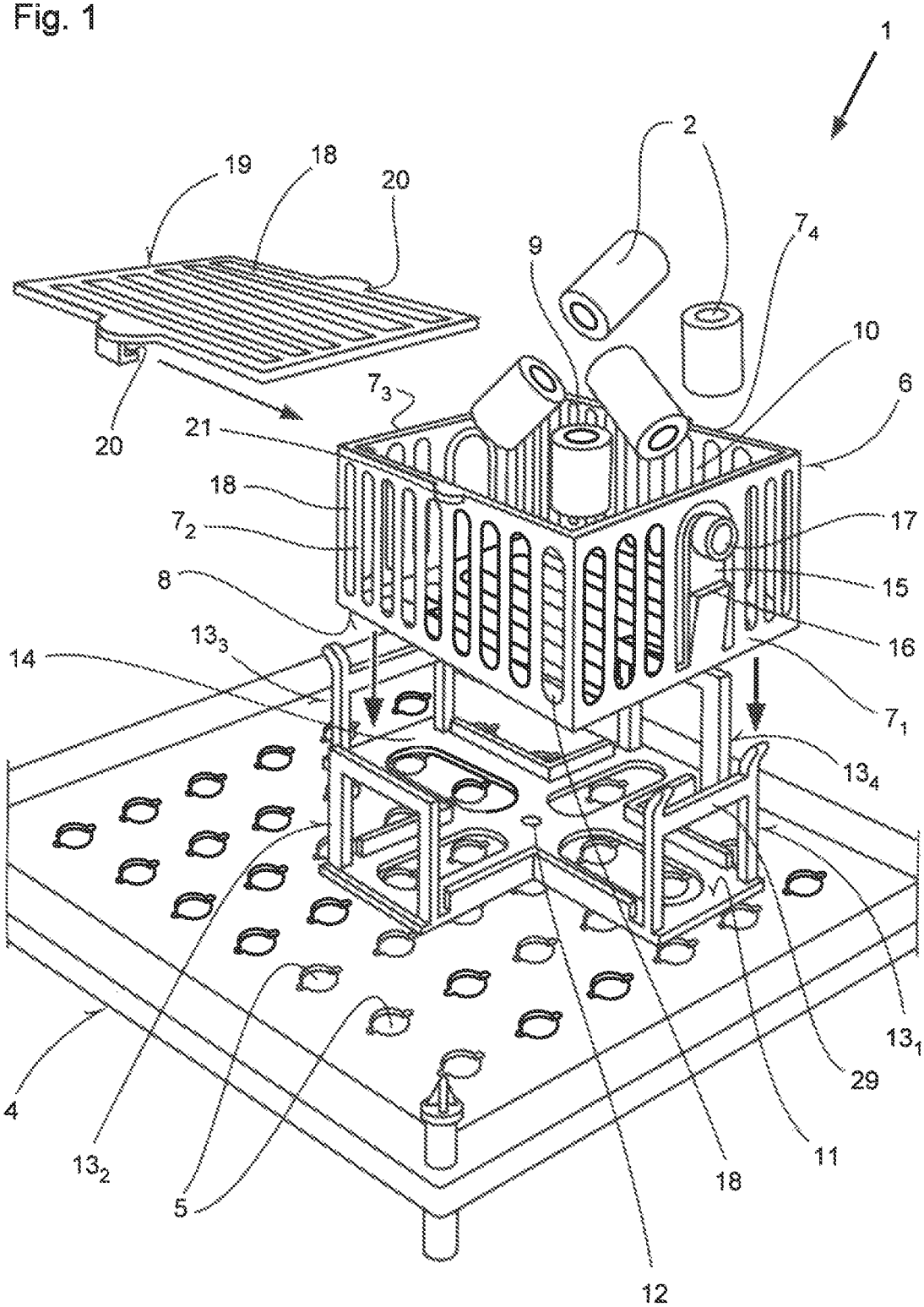
FIG. 1 shows a device with a cage in which a plurality of objects are filled, with a support frame in which a plurality of accommodation openings are incorporated and with an adapter which can on the one hand be fastened to the support frame and on the other hand fixes the cage, in perspective view and in the state of insertion of the cage.
Figure 2:
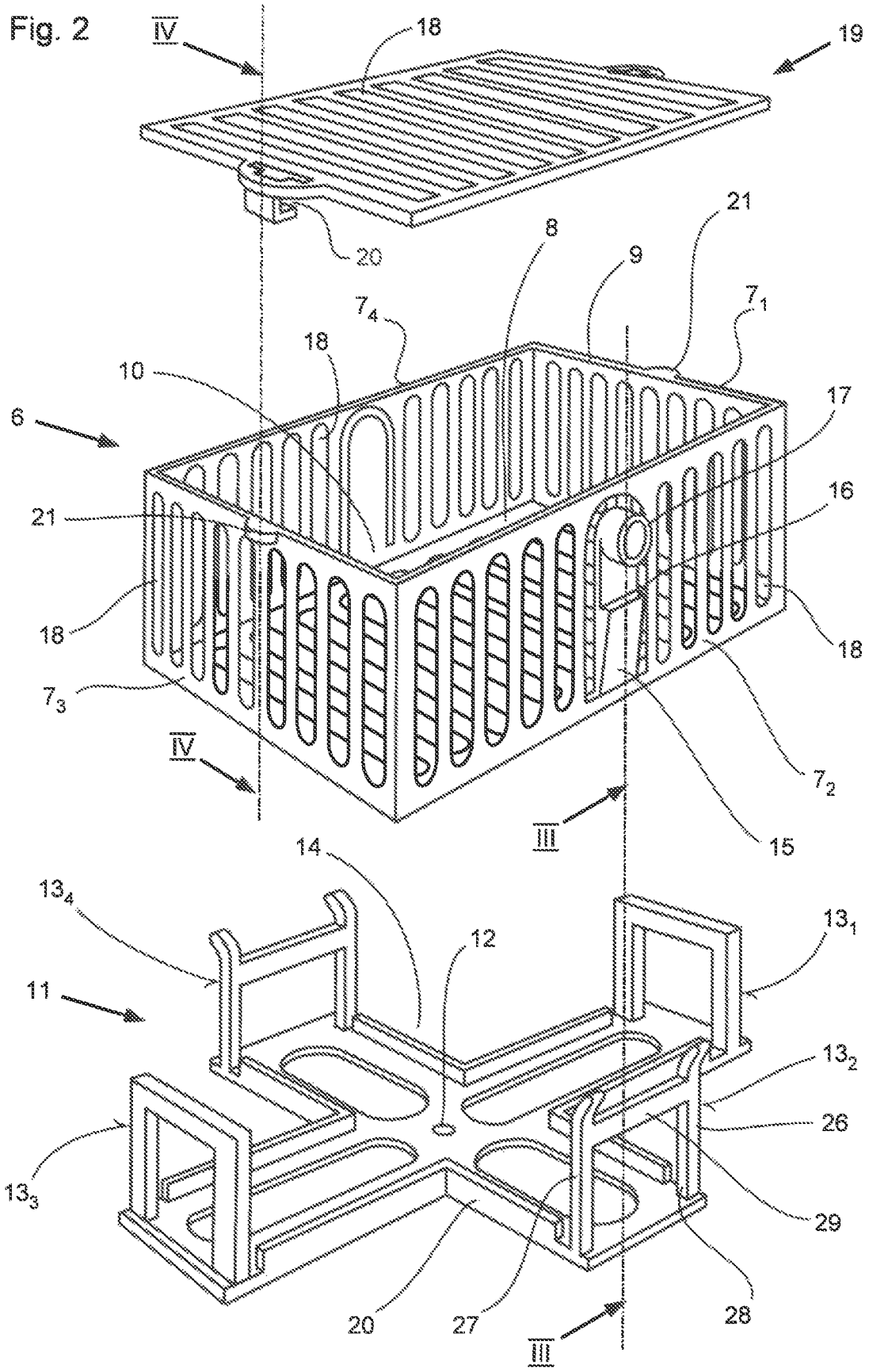
FIG. 2 shows the device in accordance with FIG. 1, in an exploded view and in the state of separation.

FIGS. 1 and 2 show a device 1 by which one of a plurality of differently configured objects 2 are accommodated during a transport, storage or processing operation. In this regard, the device 1 chiefly comprises a support frame 4 in which a plurality of accommodation openings 5 are formed, a cage 6 having four side walls $\mathbf{7}_1$, $\mathbf{7}_2$, $\mathbf{7}_3$ and $\mathbf{7}_4$ which, together with a base 8 attached thereto, form an inner space 10. The objects 2 can be filled into the inner space 10 of the cage 6 which is configured in this manner. The upper edge of each of the four side walls $\mathbf{7}_1$ to $\mathbf{7}_4$ facing away from the base 8 is marked with the reference numeral 9. The end face of the cage 6 enclosed by the upper edge 9 is open for the filling process of the objects 2.

In addition, the device 1 is associated with an adapter 11 in the centre of which a vertically projecting holding pedestal 12 is formed. The holding pedestal 12 can be inserted into one of the accommodation openings 5 of the support frame 4 and locked therein. Consequently, the adapter 11 is positionally and releasably coupled to the support frame 4 in the fixed condition.

The adapter 11 consists of four support arms $\mathbf{13}_1$, $\mathbf{13}_2$, $\mathbf{13}_3$ and $\mathbf{13}_4$ extending perpendicular to one another, through which a rectangular inner space 14 is formed.

In this regard, the dimensions of the support arms $\mathbf{13}_1$ to $\mathbf{13}_4$ correspond to the largest dimensions of the outer contour of the cage 6, so that the cage 6 can be inserted between and locked with the four support arms $\mathbf{13}_1$ to $\mathbf{13}_4$ of the adapter 11, as explained in more detail below.

A plurality of recesses 18 are formed or provided in the side walls $\mathbf{7}_1$ to $\mathbf{7}_4$, in order to make the cage 6 as permeable as possible to liquid or gaseous media which are intended to reach the objects 2 stored in the cage 6.

Figure 3:
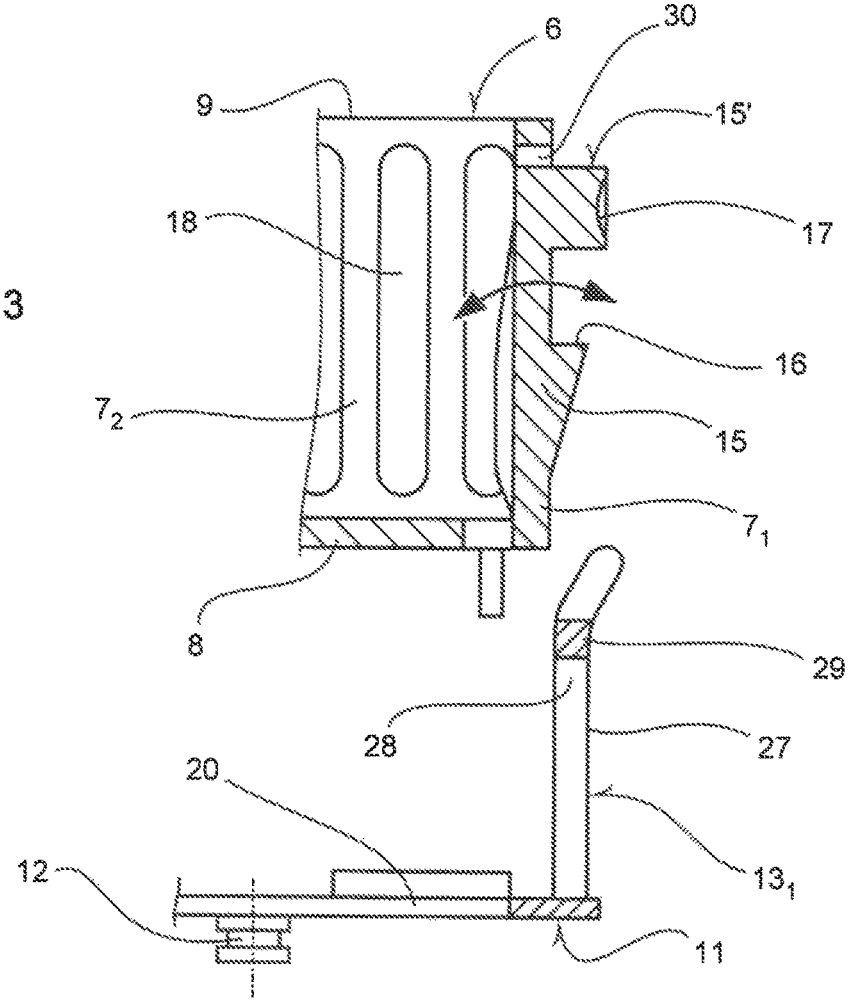
FIG. 3 shows a section along the line III-III, in accordance with FIG. 2.

Two spring bars 15 are provided on two opposing side walls $\mathbf{7}_1$ and $\mathbf{7}_3$ of the cage 6. In particular, it can be seen from FIG. 3 that the respective spring bars 15 in the area of the base 8 are pivotably mounted in the manner of a hinge. The free end of the spring bar 15 is arranged in the area of the upper edge 9 and an air gap 30 is provided between the free end 15' and the upper edge 9. Thus, the spring bar 15 can be moved inwards or outwards.

A latching lug 16 is formed or provided on the outside of the respective spring bar 15, which extends outside the plane formed by the side wall $\mathbf{7}_1$ or $\mathbf{7}_3$. A projection 17 is formed between the latching lug 16 and the free end 15' of the spring bar 15, which is accessible from the outside. The projection 17 is used to manually operate the spring bar 15 so as to pivot it about the spring bar 15 in the manner of a hinge, as explained above.

The support arms $\mathbf{13}_1$ and $\mathbf{13}_3$ comprise two legs 26, 27 arranged perpendicular to one another, which consequently form an L-shaped cross-sectional contour.

The first leg 26 acts as a stop for the cage 6 once it is fully inserted into the inner space 14 of the adapter 11. The second leg 27 has a box section 28 which is closed in cross-section and extends parallel to the respective side wall $\mathbf{7}_1$ or $\mathbf{7}_3$ of the cage 6. The geometry of the box section 28 of the respective support arms $\mathbf{13}_1$ or $\mathbf{13}_3$ is designed in such a way that it is slightly larger than the length and width of the spring bar 15. Consequently, the box section 28 of the legs 27 surrounds the spring bar 15.

When the cage 6 is moved in the direction of the adapter 11, the outwardly projecting latching lug 16 of the spring bar 15 comes into operative contact with one web 29 of the box section, which is parallel to and spaced apart from the first leg 26. Accordingly, the two opposing webs 29 of the support arms $\mathbf{13}_1$ and $\mathbf{13}_3$ press the respective spring bar 15 into the inner space 10 of the cage 6 and the latching lug 16 passes over the web 29. As soon as the latching lug 16 has completely passed over the web 29, the spring bar 15 snaps back into its initial position and the latching lug 16 rests below the web 29. Accordingly, the latching lug 16 and the web 29 form an undercut by which the cage 6 is held oriented in position on the adapter 11.

In the sample embodiment shown, all four legs 27 of the support arms $\mathbf{13}_2$ and $\mathbf{13}_4$ of the adapter 11 are likewise formed with a box section 28 which is closed in cross-section, so that the cage 6 can be inserted into the adapter 11 in any position irrespective of the configurations of the support arms $\mathbf{13}_1$ to $\mathbf{13}_4$.

To release the cage 6 from the adapter 11, the projection 17 can be manually pushed inwards so that the latching lug 16 disengages from the underside of the web 26, allowing the cage 6 to be pushed out of the adapter 11.

Figure 4:
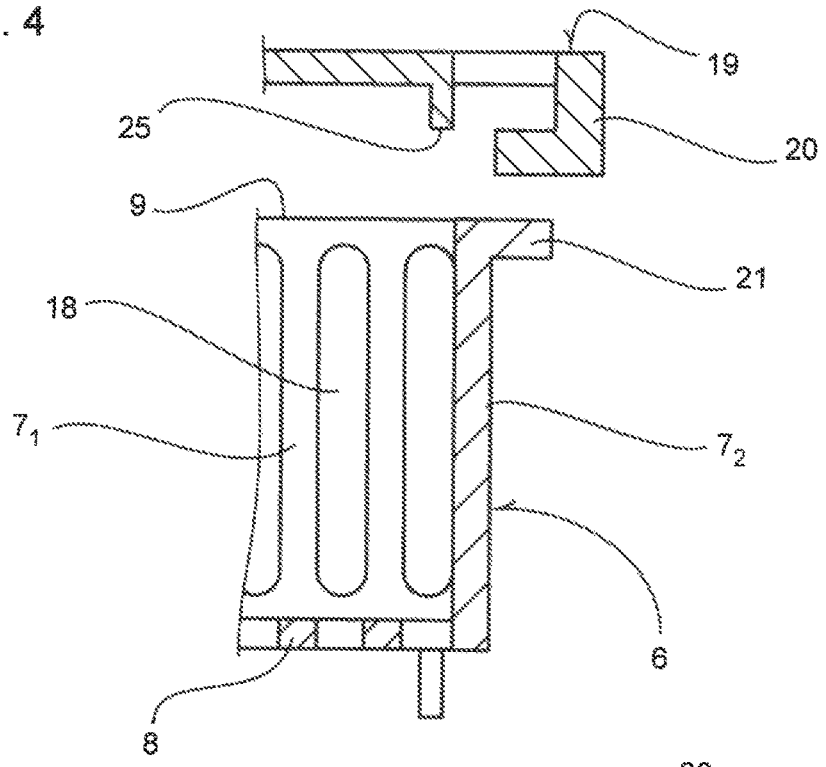
FIG. 4 shows a section along the line IV-IV, in accordance with FIG. 2

FIG. 2 further shows that the cage 6 is closed by means of a lid 19. In order to achieve reliable locking between the lid 19 and the upper edge 9 of the cage 6, a holding profile 20 with a U-shaped cross-section is provided on the latter, which consequently has a U-shaped guide channel. In particular, it can be seen from FIG. 4 that a retaining lug 21 is formed on the outside of the upper edge 9, which projects perpendicular from the side wall $7_2$ or $7_4$. Accordingly, the lid 19 can be pushed on laterally along the upper edge 9 and the respective retaining lug 21 engages in the U-shaped guide channel of the holding profile 20 of the lid 19. To prevent the lid 19 from slipping, a guide bar 25 is provided adjacent the holding profile 20 and extends perpendicular from the lid 19 into the interior of the cage 6.

Figure 5:
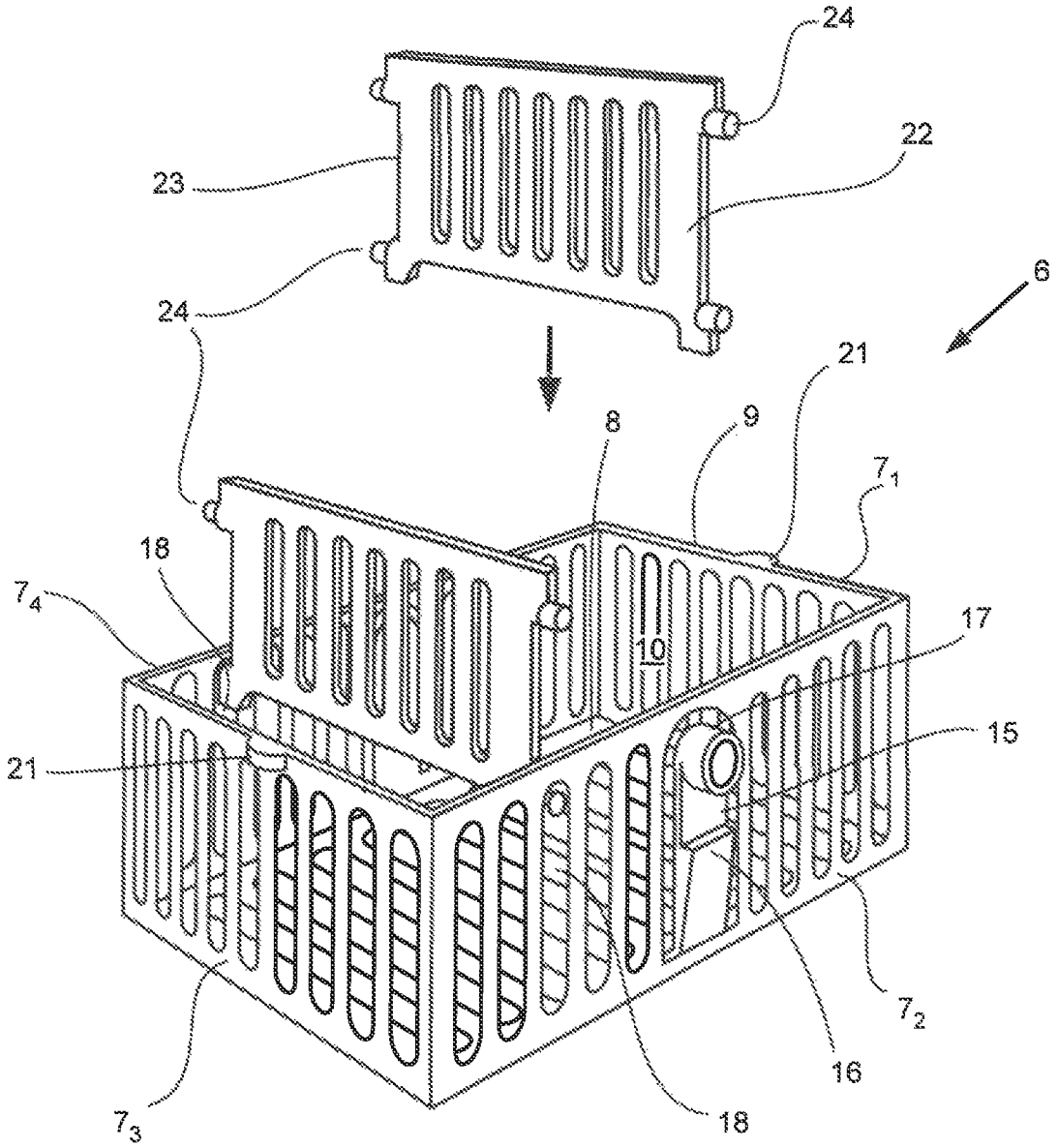
FIG. 5 shows the cage in accordance with FIG. 1, with two partition walls inserted therein to form three internal spaces within the cage.

It can be seen from FIG. 5 that the inner space 10 of the cage 6 can be divided into three smaller inner spaces 10', 10" and 10'" by means of two partition walls 22.

Each respective partition wall 22 has two latching lugs 24 formed on opposite side walls 23, which can be snapped into recesses 18 in the side walls $7_1$ to $7_4$.

What is claimed is:

1. A device (1) for holding objects (2), the device comprising:

a plate-shaped support frame (4) comprising a plurality of accommodation openings (5) formed in a top surface of the support frame (4); and a cage (6) suitable for accommodating the objects (2), the cage (6) having four side walls ($7_1$, $7_2$, $7_3$, $7_4$) and a base (8) arranged between the four side walls ($7_1$, $7_2$, $7_3$, $7_4$);

wherein an adapter (11) is provided between the support frame (4) and the cage (6), which adapter (11) comprises a holding pedestal (12) projecting in the direction of the support frame (4);

wherein the holding pedestal (12) is configured to be inserted into one of the accommodation openings (5) of the support frame (4) and locked therein;

wherein the adapter (11) comprises four support arms ($13_1$, $13_2$, $13_3$, $13_4$) projecting away from the support frame (4) to define a rectangular inner space (14) sized to receive the cage (6), wherein each of the four support arms ($13_1$, $13_2$, $13_4$, $13_4$) comprises a web (29);

wherein the cage (6) comprises at least two inwardly-deflecting spring bars (15), each spring bar (15) comprising a latching lug (16) having a latching surface configured to engage a web (29) of a support arm ($13_1$, $13_2$, $13_3$, $13_4$);

and further wherein the cage (6) is configured to mount to adapter (11) by engagement between (i) the latching surface of a latching lug (16) of a spring bar (15), and (ii) a surface of a web (29) of a support arm ($13_1$, $13_2$, $13_3$, $13_4$).

2. The device in accordance with claim 1, wherein the at least two spring bars (15) are provided on at least two diametrically-opposed e side walls ($7_1$, $7_3$ or $7_2$, $7_4$) of the cage (6).

3. The device in accordance with claim 1, wherein a projection (17) is provided on the spring bar (15) between an upper edge (9) of the cage (6) and the latching lug (16) of the spring bar (15), which projection (17) projects outboard from a side wall ($7_1$, $7_2$, $7_3$, $7_4$) of cage (6).

4. The device in accordance with claim 1, wherein the spring bar (15) comprises a first end and a second end, and further wherein spring bar (15) is pivotably mounted at the first end of the spring bar (15) to the respective side wall ($7_1$, $7_3$ or $7_2$, $7_4$) of the cage (6), and wherein the second end (15') of the spring bar (15) is spaced away from an upper edge (9) of the cage (6) by an air gap (30).

5. The device in accordance with claim 1, wherein a plurality of recesses (18) are formed in each of the side walls ($7_1$, $7_2$, $7_2$, $7_4$) of the cage (6), such that a medium may pass through the plurality of recesses (18) into an inner space (10) of the cage (6) defined by side walls ($7_1$, $7_2$, $7_3$, $7_4$).

6. The device in accordance with claim 1, wherein side walls ($7_1$, $7_2$, $7_3$, $7_4$) of cage (6) define an upper edge (9) of cage (6), and further wherein a lid (19) may be mounted to the upper edge (9) so as to enclose an inner space (10) of the cage (6) defined by side walls ($7_1$, $7_2$, $7_3$, $7_4$).

7. The device in accordance with claim 6, wherein the lid (19) comprises four sides, and wherein two holding profiles (20) having U-shaped guide channels are disposed on opposite sides of the lid (19), and wherein the upper edge (9 of cage (6) comprises two retaining lugs (21) that project outboard of the upper edge (9) of cage (6) and are configured to be received within the guide channels of the holding profiles (20) so as to mount the lid (19) to cage (6).

8. The device in accordance with claim 1, wherein at least one partition wall (22) is inserted into an inner space (10) defined by the sidewalls ($7_1$, $7_2$, $7_3$, $7_4$) of the cage (6), and further wherein the at least one partition wall is mounted to two diametrically-opposed side walls ($7_1$, $7_2$, $7_3$, $7_4$) of the cage (6), whereby to divide the inner space (10) of the cage (6) into at least two inner spaces (10', 10") which are separated from one another.

9. The device in accordance with claim 8, wherein the at least one partition wall (22) comprises at least one latching lug (24) configured to engage at least one recess (18) formed in a side wall ($7_1$, $7_2$, $7_3$, $7_4$) of the cage (6) so as to mount the at least one partition wall (22) to the cage (6).

10. The device in accordance with claim 1, wherein the support arms ($13_1$, $13_2$, $13_3$, $13_4$) of the adapter (11) each comprise two legs (26, 27) which are aligned in an L-shape with respect to one another, in that the first leg (26) serves as a base or stop for the cage (6), and in that the second leg (27) is designed in cross-section as a closed box section (28).

11. The device in accordance with claim 10, wherein the webs (29) of the support arms ($13_1$, $13_2$, $13_3$, $13_4$) serve as a stop for the latching lug (16) of the at least two spring bars (15).

12. The device in accordance with claim 11, wherein a width and length of the box section (28) are slightly larger than the width and length of at least two spring bars (15).

* * * * *